United States Patent [19]

Mitter

[11] 4,232,601

[45] Nov. 11, 1980

[54] SQUEEGEE ARRANGEMENT

[75] Inventor: Mathias Mitter, Schloss Holte, Fed. Rep. of Germany

[73] Assignee: Mitter & Co., Schloss Holte, Fed. Rep. of Germany

[21] Appl. No.: 7,403

[22] Filed: Jan. 29, 1979

Related U.S. Application Data

[63] Continuation of Ser. No. 817,106, Jul. 19, 1977, abandoned.

[30] Foreign Application Priority Data

Jul. 20, 1976 [DE] Fed. Rep. of Germany ..... 2632522

[51] Int. Cl.[3] ..... B41F 15/46; B41F 15/42

[52] U.S. Cl. ..... 101/120; 101/155; 101/169

[58] Field of Search ..... 101/120, 155–157, 101/167–169

[56] References Cited

U.S. PATENT DOCUMENTS

| | | | |
|---|---|---|---|
| 945,264 | 1/1910 | Dick | 101/120 |
| 3,795,188 | 3/1974 | Giani | 101/120 |
| 3,878,780 | 4/1975 | Lotte | 101/120 |
| 3,901,146 | 8/1975 | Stierlein | 101/120 |
| 3,930,445 | 1/1976 | Jaffa | 101/120 |
| 4,030,410 | 6/1977 | Zimmer | 101/120 |
| 4,038,919 | 8/1977 | Lotte | 101/120 |
| 4,078,486 | 3/1978 | Moser | 101/120 |
| 4,103,615 | 8/1978 | Cruz | 101/120 |

FOREIGN PATENT DOCUMENTS

| | | | |
|---|---|---|---|
| 2319905 | 11/1974 | Fed. Rep. of Germany | 101/120 |
| 2331322 | 1/1975 | Fed. Rep. of Germany | 101/120 |
| 576868 | 6/1976 | Sweden | 101/120 |

*Primary Examiner*—Clyde I. Coughenour
*Attorney, Agent, or Firm*—Michael J. Striker

[57] ABSTRACT

A squeegee arrangement has a holder which supports a squeegee member having a squeegee blade. A supporting block on the holder engages and supports the squeegee member. A spring element engages the squeegee blade at or in the vicinity of the longitudinally extending free edge thereof.

4 Claims, 3 Drawing Figures

SQUEEGEE ARRANGEMENT

This is a continuation, of application Ser. No. 817,106, filed July 19, 1977 now abandoned.

BACKGROUND OF THE INVENTION

This invention relates to a squeegee arrangement, particularly one which is suitable for use in screen printing machines.

Squeegee arrangements must be readily mountable, easily cleanable and, perhaps most importantly, readily adjustable for various circumstances, such as the required ink (the term is used generically herein to designate coloring matter) application angle. This is the angle formed by the ink pool confined between the printing screen and the squeegee blade. This pool is of essentially wedge-shaped cross-section. It is known from fluid dynamics that the flatter a wedge shape into which a flowable substance is forced, the higher will be the pressure in the wedge-shaped area.

It is this pressure, present in all squeegee arrangements of the type under discussion and exerted by the ink as a function of the relative displacement of squeegee and printing screens, which causes the ink (usually of paste-like consistency) to be forced through the screen and onto (or into) the workpiece to be printed. This same pressure of course also exerts a reaction force upon the squeegee blade.

In known squeegee arrangements the reaction force is resisted by, e.g. a supporting block of the squeegee holder. However, whatever means have heretofore been provided for this purpose (to resist the reaction force and thus maintain the squeegee blade against displacement out of its proper operating position), have been unsatisfactory because they tend to also change the spring characteristic of the squeegee blade itself in an undesirable manner, namely by making the blade rigid in the area where it contacts the printing screen.

Thus, the more strongly the blade is supported against the reaction force, the harder will be the contact between it and the screen which has to be accepted as a trade-off for the supporting function. This is, evidently, a negative change in the squeegee-blade spring characteristic. Conversely, of course, the less supported the blade against deflection by the reaction force, the more it is deflected by this force and the more the angle of ink ejection through the screen will be changed. The spring characteristic of the blade is now too soft.

Heretofore it has been the industry practice to use different squeegee blades for different conditions. However, removal of the old and installation of the new blade is always a difficult and time consuming effort, requiring complete machine shut-down.

Proposals made for squeegee arrangements in German published application (DT-OS) 2,405,108 and in German patent (DT-PS) 1,964,182 and German allowed application (DT-AS) 1,121,074, have all been found unsatisfactory for overcoming the problems outlined above.

SUMMARY OF THE INVENTION

Accordingly, it is an object of the invention to avoid the disadvantages of the prior art.

More particularly, it is an object to provide an improved squeegee arrangement (particularly for use in screen printing machines) wherein the spring characteristic of the squeegee blade is such that it increases uniformly over a relatively wide range of variations, i.e. under varying circumstances. The squeegee blade itself is to be elastically deformable to keep its friction with the printing screen low, and in order to avoid energy losses resulting from its contact with the screen.

In pursuance of these and other objects one feature of the invention resides in a squeegee arrangement, particularly for use in screen printing machines. Briefly stated, the arrangement may comprise a squeegee member having a squeegee blade of elastically deformable material, a holder for the squeegee member, a supporting blade on the holder and engaging the squeegee member, and a spring element engaging the squeegee blade and deflecting the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
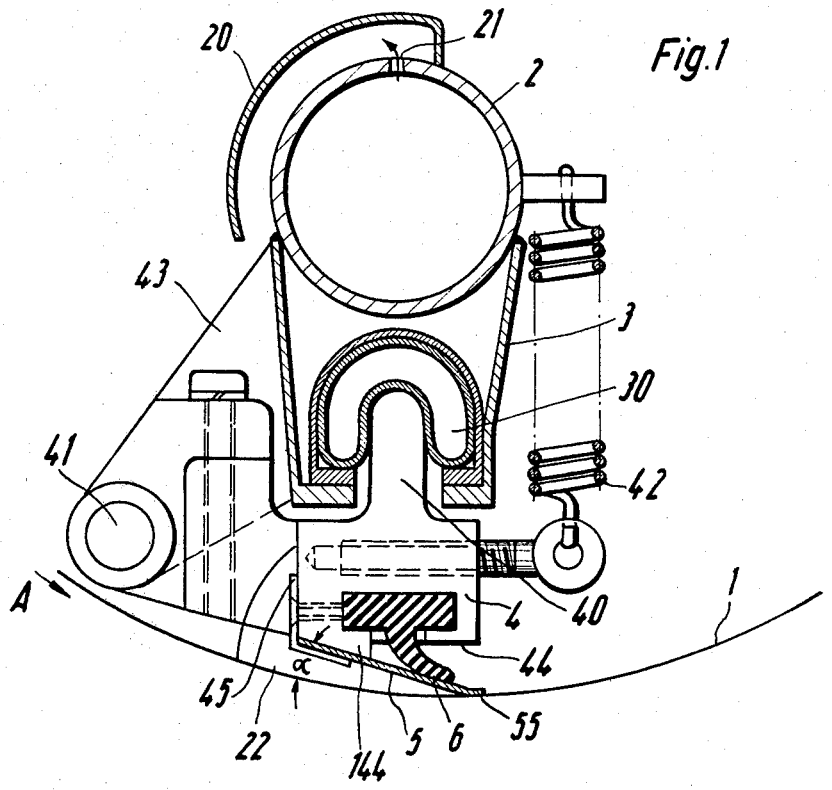
FIG. 1 is a fragmentary side view, partly in section, showing an embodiment of the invention in the context of a rotary-screen printing machine.

FIG. 1 illustrates in part a printing screen 1 of a rotary screen printing machine. Such screens are tubular, i.e. of circumferentially endless hollow cylindrical shape. The screen 1 rotates in direction of the arrow A. The invention can, however, also be used with flat printing screens and with endless-belt printing screens.

An ink supply tube 2 extends over the entire axial length of the tubular printing screen 1. It has a cover or hood 20 beneath which ink is forcibly ejected from the tube 2 through opening(s) 21. The ink then runs into an ink sump or pool 22 which is located ahead of (as considered in the direction of rotation A) the squeegee member 5. The cross-sectional shape and size of the pool 22 changes in dependence upon the quantity of ink supplied via tube 2 per unit time and upon the speed of travel of the screen 1 in direction A.

The squeegee arrangement according to the invention is mounted within the space surrounded by the screen 1, by means of a mount 3 which surrounds a gas-filled envelope 30 forming a gas cushion. This cushion bears upon an upper bar 40 of a squeegee holder 4 which is tiltably mounted on shaft 41 and resiliently restrained from such tilting by springs 42. Shaft 41 is mounted on consoles 43 (one shown) which are distributed over the axial length of the tube 2. Cushion 30 exerts downward pressure to urge the squeegee member 5 towards the inner surface of screen 1; the exerted pressure acts upon the free edge region of the blade of the squeegee member 5 above a spring element 6, as will be subsequently described.

At the lower side 44 of the holder 4 there is provided a supporting block 144 against which a retaining element 45 (e.g. a clamping bar) for the squeegee member 5 bears. The squeegee member 5 can be clamped or otherwise secured between the elements 144 and 45.

It is important that in the rear part of the angle $\alpha$ (see FIG. 1) the squeegee member 5 is held rigidly. The projecting part of member 5 (i.e. the squeegee blade), however, is supported in the region of its free edge (and screen-contact line 55) by an elastically yieldable spring element 6. This may be tongue-shaped in form of either a leaf spring or else in form of an elastomeric (i.e. rubber or rubber-like) member. The member 6 engages the rear side of the squeegee blade (i.e. the one facing upwardly away from contact line 55) at an acute angle and extends with its free end to or substantially to the line 55; under stronger pressure the member 6 slides on the rear side of the squeegee blade. The cross section of member 6, especially if the latter is elastomeric as shown, may be T-shaped and the member 6 may be matingly mounted in holder 4.

The arrangement assures that the squeegee blade is elastically supported close to the contact line 55 and even if the ink wedge 22 has an acute angle $\alpha$ and is under high pressure, the squeegee blade cannot flutter. Again, should the liquid pressure be low and the angle $\alpha$ be greater than shown, proper contact along the line 55 is still assured.

Figure 2:
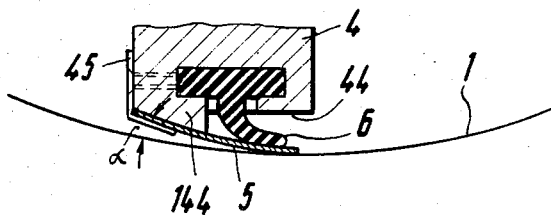
FIG. 2 is a view analogous to FIG. 1, but with details of that FIGURE omitted, showing another embodiment.

FIG. 2 is the same as FIG. 1, although parts have been omitted for simplicity, except that it shows that the angle $\alpha$ of FIG. 1 can be different and the invention will still be effective.

Figure 3:
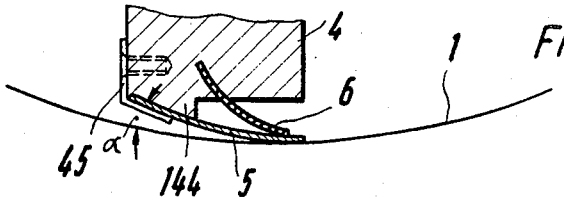
FIG. 3 is a view similar to FIG. 2 but of still a further embodiment of the invention.

FIG. 3 is also the same as FIG. 1 except to show that the spring element 6′ can be in form of a metallic leaf spring. Of course, synthetic plastic material can be used for the element 6′ (irrespective of which shape it has); such material can be readily cleaned of adhering ink.

The arrangement according to the invention has a variety of significant advantages. Thus, the squeegee blade 5 may be made of steel (as shown) and will have little friction with respect to the screen 1. Even though the form of blade 5 may change substantially (due to deflection), the force with which it presses against the screen 1 will change only very little. The arrangement will always be properly positioned with reference to the direction of screen movement and any unevenness (e.g. the inner screen surface) will be readily accommodated because the squeegee blade 5 can flex freely and readily.

The blade 5 can adjust itself to different conditions over the widest possible range (e.g. when the blade 5 is urged towards or tends to recede upwardly from the screen under the influence of changes in the relatively variable gas pressure in envelope 30). The elasticity of blade 5 remains substantially unchanged over a wide range of different contact pressures (of blade 5 on screen 1) and the supporting force exerted upon the blade 5 by the element 6 or 6′ will become only gradually stronger as the contact pressure of blade 5 on screen 1 increases. As this takes place the angle included between the elements 5 and 6 also changes, in that it becomes smaller.

Also, the arrangement according to the invention is very simple and inexpensive and can be readily cleaned and maintained.

While the invention has been illustrated and described as embodied in a squeegee arrangement for a rotary-screen printing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a screen printing machine having a printing screen which rotates in a predetermined direction and has an inner surface, a squeegee arrangement comprising a holder spaced from said inner surface and including a face directed towards the same and composed of a substantially horizontal face portion and an inclined face portion which slopes from the level of said horizontal face portion towards said inner surface in said predetermined direction; a squeegee blade of elastically deformable material having a center portion flanked by one longitudinal edge portion which lies on said inclined face portion, and another longitudinal edge portion a margin of which is in sliding engagement with said inner surface of the screen; means fixedly connecting said one longitudinal edge portion to said holder; a solid cross-section spring element of resiliently yieldable material extending along said squeegee blade and having a mounting part secured in said holder and a tongue part projecting outwardly from said horizontal face portion above said center portion of said squeegee blade and having a free edge region engaging said squeegee blade along and in direct contact with said other longitudinal edge portion, said tongue part being resiliently stressed between said holder and said squeegee blade and deflected in direction away from said inner surface and generally in said predetermined direction towards said holder so that yielding of said squeegee blade in direction away from said inner surface of the screen is a function of the combined resistance offered to such yielding by the deflection of said squeegee blade and the deflection of said tongue part; and variable fluid-pressure means directly above said holder and operative for urging the same towards said inner surface with a variable pressure, so as to permit varying of the combined yielding resistance offered by said squeegee blade and tongue part.

2. An arrangement as defined in claim 1, said spring element being of elastomeric material.

3. An arrangement as defined in claim 2, said elastomeric material being rubber.

4. An arrangement as defined in claim 1, said spring element being a leaf spring.

* * * * *